US005664359A

United States Patent [19]

Sabranski et al.

[11] Patent Number: 5,664,359

[45] Date of Patent: Sep. 9, 1997

[54] RIFLED WEAPON BARREL AND METHOD OF MAKING THE SAME

[75] Inventors: Udo Sabranski, Lachendorf; Henning Von Seidlitz, Neuss; Ralf-Joachim Herrmann, Senzig, all of Germany

[73] Assignee: Rheinmetall Industrie GmbH, Ratingen, Germany

[21] Appl. No.: 702,033

[22] Filed: Aug. 23, 1996

[30] Foreign Application Priority Data

Aug. 23, 1995 [DE] Germany ..... 195 30 920.0
Dec. 1, 1995 [DE] Germany ..... 195 44 824.3

[51] Int. Cl.[6] ..... F41A 21/00

[52] U.S. Cl. ..... 42/78; 42/76.02; 42/76.01

[58] Field of Search ..... 42/78, 76.02, 76.01; 148/102, 545, 548, 607, 682, 851

[56] References Cited

U.S. PATENT DOCUMENTS

| | | | |
|---|---|---|---|
| H1365 | 11/1994 | Amspacker et al. | 42/78 |
| 2,395,044 | 2/1946 | Gorton | 42/76 |
| 3,780,465 | 12/1973 | Polcha | 42/76 A |
| 4,414,038 | 11/1983 | Dausinger et al. | 148/4 |
| 4,622,080 | 11/1986 | Wegwerth | 148/12 R |
| 4,854,148 | 8/1989 | Mayer | 72/68 |

FOREIGN PATENT DOCUMENTS 2 045 738 3/1972 Germany .

*Primary Examiner*—Charles T. Jordan
*Assistant Examiner*—Meena Chelliah
*Attorney, Agent, or Firm*—Spencer & Frank

[57] ABSTRACT

A weapon barrel includes a muzzle, a breech, a chamber at the breech and a rifling, formed of alternating lands and grooves, extending along an interior of the weapon barrel. The lands have a hardened surface to a depth of 0.3 to 0.5 mm. The hardened surface extends along a barrel length portion which includes the muzzle.

5 Claims, 3 Drawing Sheets

RIFLED WEAPON BARREL AND METHOD OF MAKING THE SAME

CROSS REFERENCE TO RELATED APPLICATION

This application claims the priority of German Application Nos. 195 30 920.0 filed Aug. 23, 1995 and 195 44 824.3 filed Dec. 1, 1995, which are incorporated herein by reference.

BACKGROUND OF THE INVENTION

The invention relates to a rifled weapon barrel having a chamber at its breech and a method of making a rifled weapon barrel.

To maintain barrel erosion caused by the hot propellant gases at a low level to thus increase the life expectancy of the barrel, it is known to provide the inside of the barrel—usually made of steel—with a hard-metal layer such as a chromium layer or an alloy layer containing chromium (such as a cobalt-chromium-tungsten alloy).

It has been found in practice that particularly in large-caliber barrels (artillery pieces, tank cannons and the like) in the muzzle region of the barrel a relatively more pronounced surface wear occurs, caused by the friction between the projectile and the barrel. The resulting damages to the hard-metal layer of the barrel cause an engraving of the land profile of the barrel rifling into the projectile whereby the flight attitude of the projectiles fired from such a gun is unintentionally affected.

German Offenlegungsschrift (application published without examination) U.S. Pat. No. 2,045,738 and U.S. Pat. No. 2,395,044 disclose weapon barrels which are provided with a hard-metal layer only in the chamber zone and in the barrel region immediately adjoining such chamber zone because it is primarily such a barrel region that is exposed to erosion due to the hot propellant gases.

Particularly in the muzzle zone, that is, in the frontal barrel half, such known weapon barrels too, involve problems such as land surface wear, groove and land surface engraving on the projectile and the like due to the friction between the projectile and the barrel.

SUMMARY OF THE INVENTION

It is an object of the invention to provide an improved weapon barrel of the above-outlined type in which the land surface wear caused by friction between the projectile and the barrel is low, particularly in the muzzle region of the barrel.

It is a further object of the invention to provide an improved method of making such a barrel.

These objects and others to become apparent as the specification progresses, are accomplished by the invention, according to which, briefly stated, the weapon barrel includes a muzzle, a breech, a chamber at the breech and a rifling, formed of alternating lands and grooves, extending along an interior of the weapon barrel. The lands have a hardened surface to a depth of 0.3 to 0.5 mm. The hardened surface extends along a barrel length portion which includes the muzzle.

In essence, the invention is based on the principle that the lands of the barrel rifling are, at least in the muzzle region, surface-hardened, preferably to a depth of between 0.3 and 0.5 mm.

The hardness of the surface-hardened barrel portion should be at least 650 on the Vickers scale.

The surface-hardened portion extends preferably at least along one half of the barrel length.

If, for reducing the barrel erosion caused by the propellant gases, the barrel is provided with an additional hard-metal layer in the zone of the chamber, then for reducing wear of the land surface, preferably only the lands of the rifling between the muzzle and the barrel portion coated with hard metal are surface-hardened.

In weapon barrels in which propellant combustion occurs at a relatively low pressure and low temperature upon firing the projectile, the additional hard metal layer is often dispensed with because the land wear in the muzzle zone, caused by the friction between the projectile and the barrel, is significantly greater than the erosion in the region close to the chamber. In such barrels it has been found to be advantageous to surface-harden the barrel not only in the muzzle zone, but also in the chamber zone for reducing the barrel erosion of the entire barrel.

For hardening the land surfaces of the barrel portion at the muzzle side, a hardening by means of laser beams has been found to be particularly advantageous because the wear region to be hardened may be positively and briefly heat-treated so that a separate cooling process may be dispensed with, and the workpiece distortion is very slight. In such a laser procedure barrel portions with difficult access may be easily reached by means of mirrors.

DESCRIPTION OF THE PREFERRED EMBODIMENTS

Figure 1:
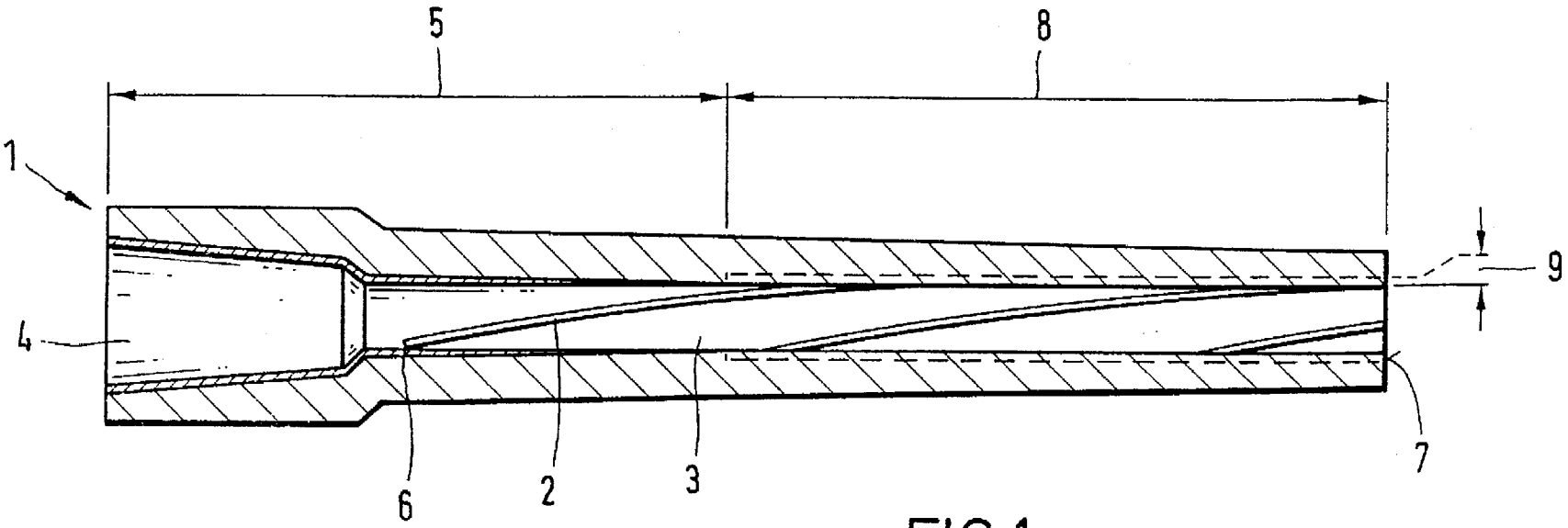
FIG. 1 is an axial sectional view of a weapon barrel according to a preferred embodiment of the invention in which only one part of the barrel length is hardened.

Turning to FIG. 1, there is shown a weapon barrel 1 provided with a rifling formed of helically extending grooves 2 separated by lands 3. The barrel 1 has a chamber 4 at the barrel breech. The weapon barrel 1 is, along a first barrel length portion 5 which includes the chamber 4, provided with a hard-metal layer 6 which may be, for example, a chromium alloy. Along a second barrel length portion 8 which extends from the end of the length portion 5 to the muzzle 7, the inner surface of the barrel 1 is hardened to a predetermined surface depth 9 of between 0.3 and 0.5 mm.

Figure 2:
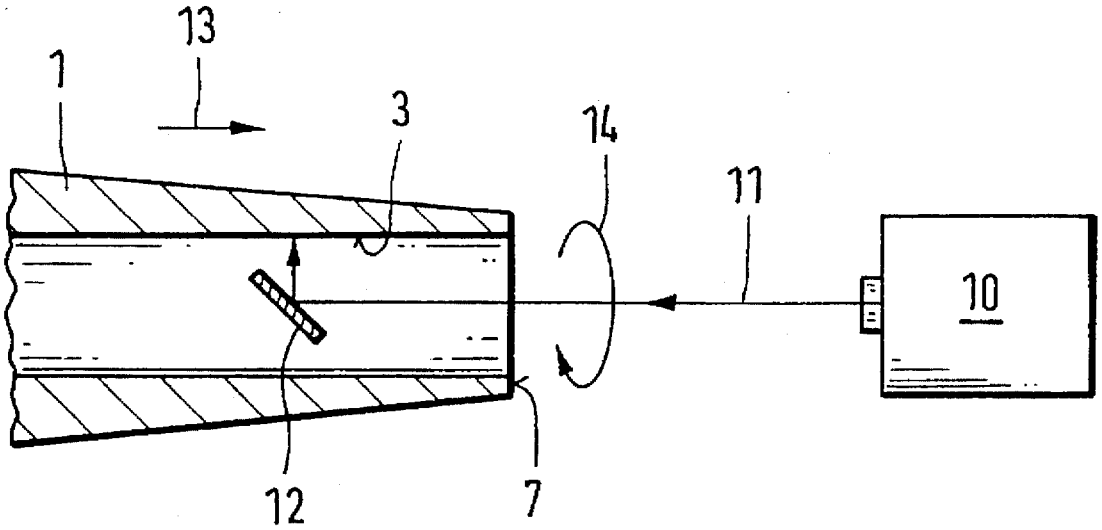
FIG. 2 is a fragmentary axial sectional view of the muzzle region of the weapon barrel showing surface hardening with a laser beam.

The hardening of the barrel length portion 8 is effected by means of a laser beam as illustrated in FIG. 2. A 5 kilowatt $CO_2$ laser beam generator 10 emits a laser beam 11 which enters axially the barrel muzzle 7. By means of a mirror 12 supported within the barrel 1, the laser beam 11 is deflected and directed orthogonally onto the land surfaces 3 to be hardened. The land surfaces 3 are preferably blackened to minimize the reflection of the laser beam 11.

A relative axial and radial motion is generated between the weapon barrel 1 and the mirror 12 as indicated by arrows 13 and 14 such that the impingement spot of the laser beam follows the helical course of the rifling. By means of the parameters such as laser beam output, area of impingement spot and process speed, the output density ($10^3$ to $10^5$ $W/cm^3$) and the duration of treatment and thus the energy introduced into the surface layer of the weapon barrel 1 per surface unit is controlled.

Figure 3:
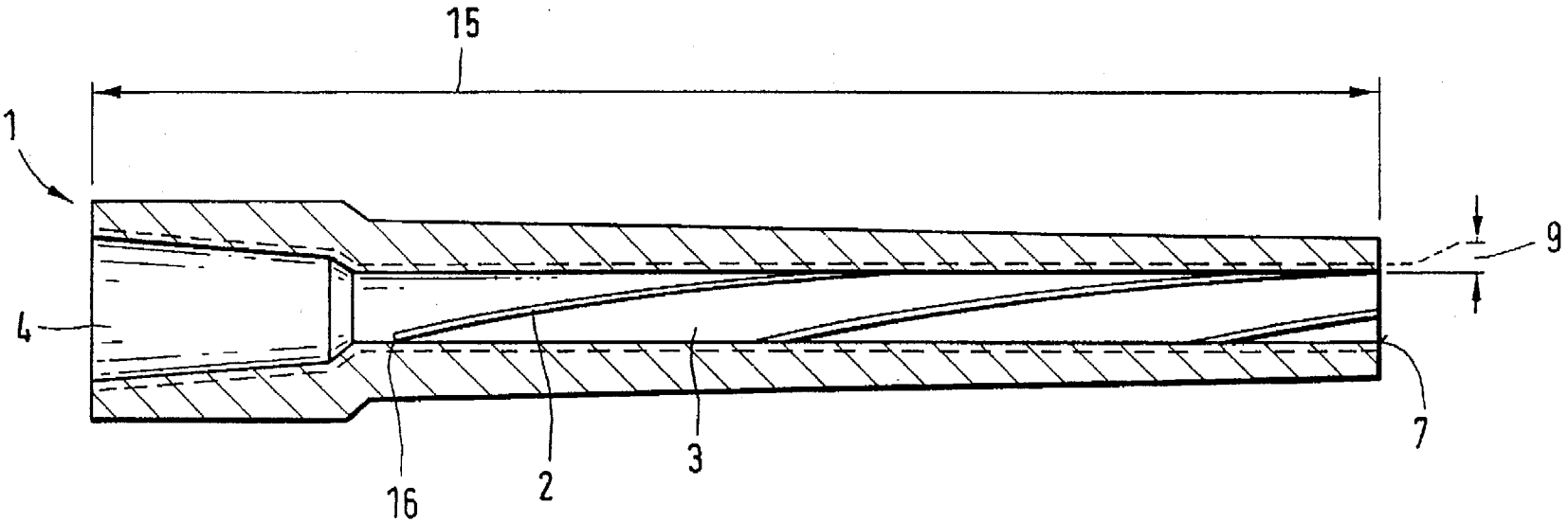
FIG. 3 is an axial sectional view of a weapon barrel according to another preferred embodiment of the invention in which the barrel is surface hardened along its entire length.

FIG. 3 illustrates another embodiment of the invention from which the hard metal layer is omitted. Instead, the interior of the weapon barrel is, along its entire length 15, surface-hardened so that a throughgoing hardened surface 16 is obtained.

It will be understood that the above description of the present invention is susceptible to various modifications, changes and adaptations, and the same are intended to be comprehended within the meaning and range of equivalents of the appended claims.

What is claimed is:

1. A weapon barrel comprising (a) a muzzle;

(b) a breech;

(c) a chamber at said breech; and (d) a rifling, formed of alternating lands and grooves, extending along an interior of said weapon barrel; said lands having a hardened surface to a depth of 0.3 to 0.5 mm; said hardened surface having a hardness of at least 650 on the Vickers scale and extending along a length portion of said barrel; said length portion including said muzzle.

2. The weapon barrel as defined in claim 1, wherein said weapon barrel has a full length; further wherein said length portion is at least one half of said full length.

3. The weapon barrel as defined in claim 1, wherein said weapon barrel has a full length; further wherein said hardened surface extends along said full length.

4. The weapon barrel as defined in claim 1, wherein said weapon barrel has a full length composed of first and second consecutive length portions; said first length portion including said muzzle and said second length portion including said chamber; said hardened surface extending solely throughout said first length portion; further comprising a hard-metal surface layer extending in said interior solely throughout said second length portion.

5. A method of providing lands of a weapon barrel rifling with a hardened surface along a barrel length portion including a muzzle, comprising the steps of (a) directing a laser beam to said lands from the interior of the barrel; and (b) hardening the surface of the lands to a depth of 0.3 to 0.5 mm by the laser beam.

* * * * *